US010180659B2

(12) United States Patent
Wiederrecht

(10) Patent No.: US 10,180,659 B2
(45) Date of Patent: Jan. 15, 2019

(54) DEVICE FOR ASSEMBLING AND ADJUSTING A BALANCE SPRING

(71) Applicant: AGENHOR SA, Meyrin (CH)

(72) Inventor: Jean-Marc Wiederrecht, Bernex (CH)

(73) Assignee: AGENHOR S.A., Meyrin (CH)

( * ) Notice: Subject to any disclaimer, the term of this patent is extended or adjusted under 35 U.S.C. 154(b) by 172 days.

(21) Appl. No.: 15/329,501

(22) PCT Filed: Jul. 31, 2015

(86) PCT No.: PCT/EP2015/067742

§ 371 (c)(1),
(2) Date: Jan. 26, 2017

(87) PCT Pub. No.: WO2016/016456

PCT Pub. Date: Feb. 4, 2016

(65) Prior Publication Data

US 2017/0212473 A1 Jul. 27, 2017

(30) Foreign Application Priority Data

Aug. 1, 2014 (EP) ..... 14179606

(51) Int. Cl.
*G04B 17/32* (2006.01)
*G04B 18/06* (2006.01)

(52) U.S. Cl.
CPC ..... *G04B 17/325* (2013.01); *G04B 18/06* (2013.01)

(58) Field of Classification Search
CPC ..... G04B 17/325; G04B 17/34; G04B 18/02; G04B 18/023; G04B 18/026; G04B 18/04; G04B 18/06
See application file for complete search history.

(56) References Cited

U.S. PATENT DOCUMENTS

| | | | | |
|---|---|---|---|---|
| 3,608,303 | A * | 9/1971 | Schaad | G04B 18/02 368/175 |
| 2005/0013201 | A1* | 1/2005 | Muhle | G04B 18/023 368/175 |
| 2005/0073912 | A1 | 4/2005 | Geyer | |
| 2007/0091729 | A1* | 4/2007 | Takahashi | G04B 17/06 368/170 |

FOREIGN PATENT DOCUMENTS

| | | |
|---|---|---|
| CH | 347141 | 6/1960 |
| CH | 705440 | 3/2013 |
| WO | 2006102911 | 10/2006 |

* cited by examiner

*Primary Examiner* — Edwin A. Leon
*Assistant Examiner* — Jason Collins
(74) *Attorney, Agent, or Firm* — Duane Morris LLP; J. Rodman Steele, Jr.; Gregory M. Lefkowitz

(57) ABSTRACT

A device for assembling and adjusting a balance spring, including a base joined to a balance bridge with an adjustable angular orientation, and having a bearing surface and a bearing plate adjacent to the bearing surface, both defining a service position of the end turn of the balance spring. A first arm extends from the base and bears a locking member for the end turn, the locking member being designed to keep the terminal coil in abutment against the bearing surface. A second arm of the device extends from the base and bears a shoe that is able to be arranged at a predefined distance from the bearing surface so as to cooperate with the end turn. A movable control member is able to act on the second arm in order to deform it elastically and move the shoe with respect to the base in order to free the end turn.

20 Claims, 3 Drawing Sheets

DEVICE FOR ASSEMBLING AND ADJUSTING A BALANCE SPRING

CROSS REFERENCE TO RELATED APPLICATIONS

This application is a § 371 national stage entry of International Application No. PCT/EP2015/067742, filed Jul. 31, 2015, which claims priority to European Patent Application No. 14179606.0 filed Aug. 1, 2014, the entire content of which is incorporated herein by reference.

TECHNICAL FIELD

The present invention relates to a device for assembling and adjusting a balance spring intended to cooperate with a terminal coil of a balance spring whereof the inner end may be secured to a balance-staff of a balance, the latter being pivoted in a balance-cock.

More specifically, the invention relates to such a device including a base, intended to be assembled to the balance-cock with an adjustable angular orientation, and comprising a substantially cylindrical support surface, with a radius substantially equal to the radius of the terminal coil, and a support sole adjacent to the support surface, the support surface and the support sole defining a service position of the terminal coil, a first arm extending from the base and supporting a locking organ for locking the terminal coil arranged to keep the latter bearing against the support surface.

BACKGROUND OF THE INVENTION

In the current assembly and adjusting mechanisms, the outer end of the coil is immobilized by a balance-spring stud fixed to a balance-spring stud holder secured to a balance-cock. An index rotatable relative to the balance-spring stud holder is provided to adjust the active length of the coil. Generally, the index may have two arms: a first arm supporting two pins between which the coil is free, and a second, optional arm serving as a lever to pivot the index around the axis of the balance. When the index pivots, the active length of the coil is reduced or increased.

Other types of devices for assembling and adjusting the coil have been designed, in particular with the aim of simplifying the assembly of the balance spring and adjusting its active length. Patent application WO 2006/102911 A describes one example of this. The device described in this document has a single arm mounted by friction on the balance-cock to put the watch into beat. The arm is provided with a circular groove defining a service position of the terminal coil of the balance spring, at the bottom of which it is kept bearing by a rotating organ, striated over the portion of its periphery arranged bearing against the balance spring. According to this document, the striated rotating organ thus defines the active length of the balance spring, while two pins are also supported by the arm, on either side of the striated rotating organ and near the circular groove, to provide guiding of the terminal coil.

One primary drawback of this device comes from the structure of the organs cooperating with the terminal coil of the balance spring. Indeed, the latter is extremely fragile and delicate, and it its chronometric properties deteriorate very quickly following the mechanical stresses that it may experience. In the case of this device of the prior art, the mechanical stress that the balance spring may experience, due to its interaction with the striated rotating organ, presents a significant risk of deterioration of its qualities. In particular, the rotating organ must necessarily apply a certain pressure on the balance spring to guarantee its driving, which causes damage to the balance spring. Furthermore, it is likely that the balance spring may undergo additional damage through its cooperation with the guide pins. Typically, this type of pin requires a manual intervention, after it is assembled on the arm, to precisely adjust the distance separating it from the bottom of the circular groove. Thus, the periphery of a pin is frequently not exactly parallel to the sides of the balance spring, which may lead to friction during operation, leading to a loss of chronometric precision over time. Lastly, the mounting of the balance spring on such a device already presents a significant risk of deterioration, since it is complex to manipulate during this placement operation.

SUMMARY OF THE INVENTION

One aim of the invention is to offset the drawbacks of the known devices for assembling and adjusting the balance spring, by proposing such a device making it possible to perform a simplified assembly and adjustment of the balance spring, free of any mechanical stress that may cause damage to the balance spring.

To that end, the present invention relates to an assembly and adjustment device of the aforementioned type, further including a second arm extending from the base and supporting a sabot able to be arranged at a predefined distance from the support surface to cooperate with the terminal coil, and a control organ movable between first and second configurations and arranged such that it may be able to act on the second arm and deform it elastically to move the sabot in reference to the base, the first and second configurations of the control organ being associated, respectively, with a first position of the second arm, in which the sabot may be situated at a distance from the support surface equal to the predefined distance, and with a second position of the second arm, in which the sabot may be situated at a distance from the support surface greater than the predefined distance.

According to one preferred embodiment, the first and second configurations of the control organ may be stable configurations.

Owing to these features, the sabot defining the active length of the balance spring may be separated from the base of the device, when the balance spring is set in position or when a horologist adjusts it, then precisely resume its service position.

Preferably, the control organ may comprise an eccentric arranged on the second arm such that it may be pivoted in response to an action by a user, to go from one of its configurations to the other and exert pressure on the base, in the second configuration, such that the sabot may be situated at a distance from the support surface greater than the predefined distance.

Alternatively, the control organ may comprise an eccentric arranged on the base such that it may be pivoted in response to an action by a user, to go from one of its configurations to the other and exert pressure on the second arm, in the second configuration, such that the sabot may be situated at a distance from the support surface greater than the predefined distance.

Furthermore, the second arm may advantageously include, from the base toward its free end, a first substantially radial portion ending with a bend providing the connection with a second substantially tangential portion, the first and second portions and the bend being arranged such that the elastic deformation experienced by the second arm, in response to a change in configuration of the control organ, may occur essentially at the first portion.

Similarly, the first arm may advantageously include, from the base toward its free end, a first substantially radial portion ending with a bend providing the connection with a second substantially tangential portion, the first and second portions and the bend being arranged such that the first arm may be able to undergo an elastic deformation occurring essentially at its first portion.

Owing to such a construction, a locking organ may be used which does not risk damaging the balance spring. Indeed, the locking organ also being supported by an elastic arm, the pressure that it applies on the balance spring can be finely adjusted and the integrity of the balance spring is not compromised in case of impact.

According to one preferred variant, the locking organ may include a knurling-roller arranged on the first arm such that it may be able to pivot in response to an appropriate action by a user to translate the terminal coil in one direction or the other based on its rotation direction.

The knurling-roller may advantageously include a substantially cylindrical portion made from a synthetic material intended to be arranged bearing against the terminal coil in its service position.

In general, it is advantageously possible to provide that the sabot may be arranged abutting against the base of the device in the first position of the second arm that supports it, such that it may be positioned at the predefined distance from the support surface with a very high precision.

The present invention also relates to a clockwork movement provided with a device for assembling and adjusting a balance spring according to the features set out above, as well as a timepiece including such a clockwork movement.

BRIEF DESCRIPTION OF THE DRAWINGS

Other features and advantages of the invention will appear more clearly over the following detailed description, in reference to the appended drawings provided as non-limiting examples and in which.

DETAILED DESCRIPTION OF A PREFERRED EMBODIMENT

Figure 1:
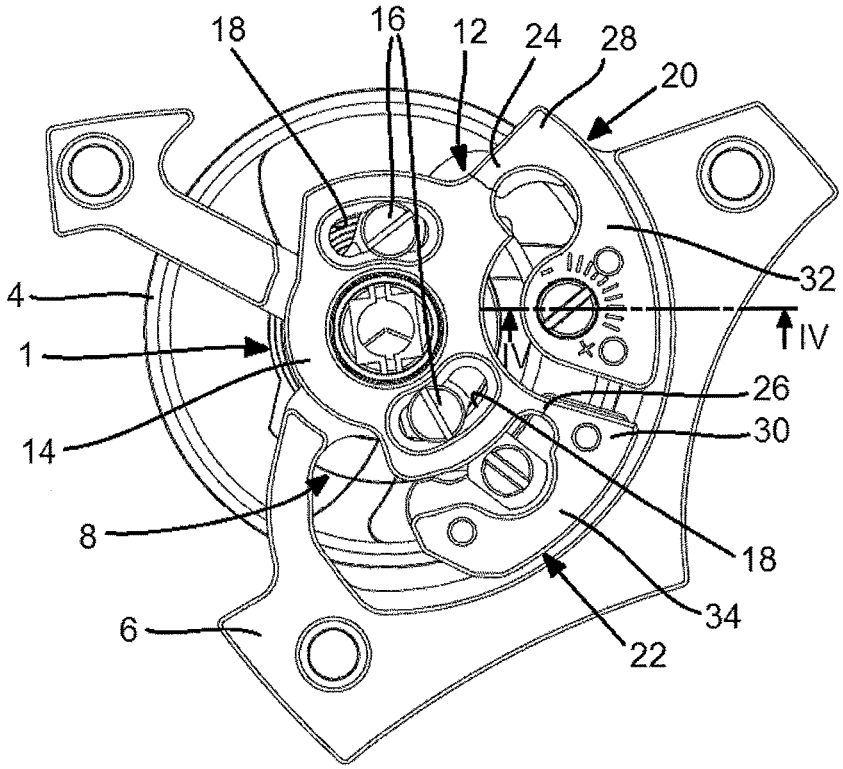
FIGS. 1 and 2 show simplified front views, according to first and second respective sides, of a sprung balance provided with a device for assembling and adjusting the balance spring according to one preferred embodiment of the invention.
Figure 2:
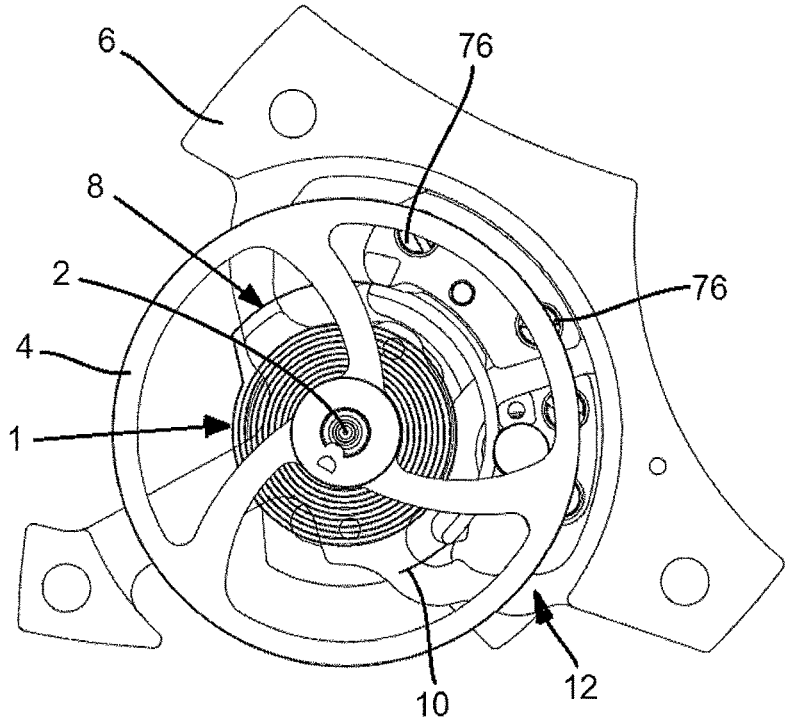

FIGS. 1 and 2 show general front views of a sprung balance provided with a device for assembling and adjusting the balance spring according to one preferred embodiment of the invention, along first and second respective sides. Typically, the view of FIG. 1 corresponds to a clockwork movement face that would be directly accessible, for example its bar side, while the view of FIG. 2 would be a view of the sprung balance on the plate side.

Conventionally, a balance spring 1 is fastened to a balance-staff 2 of a balance 4 by its inner end (not shown). The balance-staff 2 has one end mounted pivoting in a balance-cock 6, conventionally.

The balance spring 1 has a terminal coil 8 leading to its outer end 10.

The terminal coil 8 cooperates with a device 12 for assembling and adjusting the balance spring.

The device 12 includes a base 14 mounted on the balance-cock 6 with an adjustable angular orientation. To that end, here, as a non-limiting illustration, we have shown two screws 16 screwed into the balance-cock 6 and each of which traverses an oblong opening 18 arranged in the base 14. Thus, the screws 16 can be loosened slightly to allow an angular adjustment of the orientation of the device 12 in reference to the balance-cock 6. Once the screws 16 are tightened, the angular orientation of the device 12 is frozen. As will emerge from the following explanations, such an adjustment makes it possible to put the sprung balance into beat, in a known manner.

The device 12 further includes first and second arms 20 and 22, each of which supports an organ, for locking and guiding the terminal coil 8, respectively, as will emerge from the detailed description of the following figures.

Each arm 20 or 22 has a first portion 24 or 26, extending in a substantially radial direction from the base 14, and ending with a bend 28 or 30 providing the connection with a second substantially tangential portion 32 or 34. The figures show that, for each of the arms 20, 22, the first and second portions and the bend are arranged such that the arm is able to undergo an elastic deformation occurring essentially at its first portion 24, 26.

Figure 3:
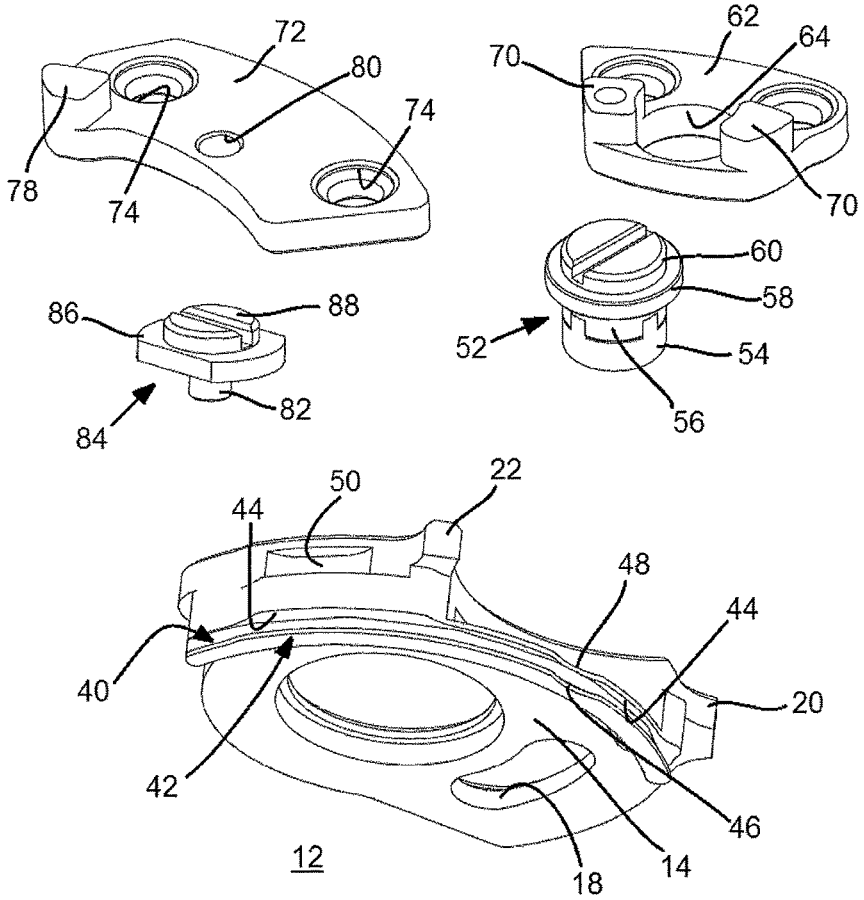
FIG. 3 shows an exploded perspective view of construction details of the device according to the preferred embodiment of FIGS. 1 and 2.
Figure 4:
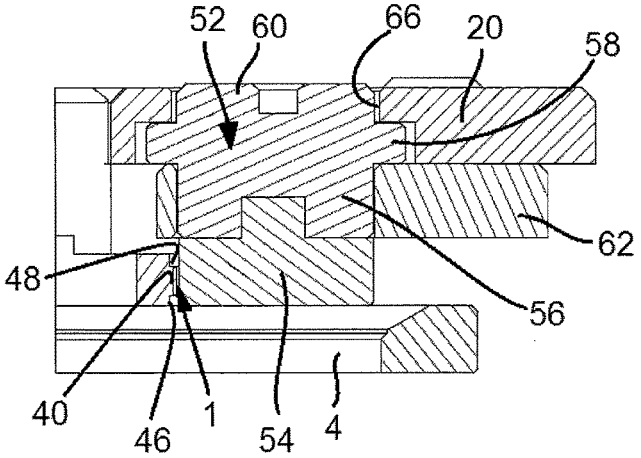
FIG. 4 shows a simplified cross-sectional view of the device according to the preferred embodiment of FIGS. 1 and 2, the section being done along line IV-IV of FIG. 1, and FIGS. 5 and 6 show simplified front views similar to the view of FIG. 1, in first and second respective configurations of the device according to the preferred embodiment of FIGS. 1 and 2.

FIGS. 3 and 4 illustrate construction details of the device 12 according to one preferred embodiment of the invention, as shown in FIGS. 1 and 2.

More specifically, FIG. 3 shows an exploded perspective view partially illustrating the assembly and adjusting device 12 according to the preferred embodiment of FIGS. 1 and 2. The first and second arms 20, 22 have been cut in the view of FIG. 3, for increased clarity.

FIG. 3 shows that the base 14 has a support surface 40, substantially cylindrical and with a radius substantially equal to the radius of the terminal coil 8, as well as a support sole 42, adjacent to the support surface 40. Furthermore, a rim 44 is partially arranged on the base 14 facing the support sole 42, preferably but optionally. The support surface 40 and the support sole 42 define a service position of the terminal coil 8, the axial maintenance of the terminal coil 8 in its service position being improved by the rim 44.

It will be noted that the support sole 42 and the rim 44 have hollows 46 and 48 arranged facing one another and the function of which will be described later.

Furthermore, the base 14 also has a recess 50, substantially in the shape of a cylinder portion, and the function of which will also be described below.

As mentioned above, the first arm 20 supports a locking organ 52, illustrated in exploded view in FIG. 3. In particular, the locking organ 52 here has, as a non-limiting illustration, a generally cylindrical shape and comprises a first portion 54, made up essentially of a synthetic material, preferably an elastomer, then a second portion 56, serving to support the first portion 54 and having substantially the same diameter as the latter. The second portion 56 ends on a third portion 58, substantially in the form of a disc here, which in turn is topped by a fourth portion 60 in the form of the screw head.

Advantageously, it is possible to provide that the second, third and fourth portions are made in a single piece, from metal or a conventional metal alloy, while the first portion 54 can be obtained for example by overmolding an elastomer on the other portions. It is in particular possible to provide a crenulation of the junctions between the first and second portions to improve their mutual holding when the locking organ pivots, as will be described later.

An assembly plate 62 is provided to assemble the locking organ 52 to the first arm 20, at its second portion 32.

The assembly mode for assembling the locking organ 52 on the first arm 20 is more particularly shown in FIG. 3, as well as in the cross-sectional view of FIG. 4, along cutting line IV-IV of FIG. 1. The first and second arms 20, 22 are only partially illustrated in these figures for better clarity.

The assembly plate 62 comprises a central hole 64 in which the second portion 56 of the locking organ 52 is arranged, such that the fourth portion 60 is housed in an appropriate hole 66 of the first arm 20 to be accessible, as in particular appears in FIG. 1. The third portion 58 of the locking organ 52 is in turn housed in an appropriate hollow 68 of the first arm 20 to ensure the blocking of the locking organ 52 between the first arm 20 and the assembly plate 62. Once the assembly is done, the first portion 54 is arranged bearing against the terminal coil 8 of the balance spring 1, at the hollows 46, 48, to ensure that it is maintained in its service position.

FIG. 3 further shows that the assembly plate 62 also includes two pillars 70, arranged on either side of the central hole 64 and each having a curved face to perform a rotational guiding function of the locking organ 52.

The second arm 22 supports a guiding organ 72 for the terminal coil 8, as shown in FIG. 3.

The guiding organ 72 has a plate shape including two holes 74 that are intended to cooperate with two screws (numerical reference 76 in FIG. 2) to ensure its assembly to the second portion 34 of the second arm 22.

Furthermore, the guiding organ 72 has a sabot 78 intended to cooperate with the terminal coil 8 of the balance spring 1 to ensure the guiding thereof in its service position, or even to define the active length of the balance spring 1, based on the distance provided between the sabot 78 and the support surface 40 in the service configuration.

Lastly, the guiding organ 72 has a hole 80 intended to house the foot 82 of an eccentric 84. The eccentric 84 comprises a substantially disc-shaped plate, two opposite portions of which are truncated, topped by a screw head 88. Once the assemblies of the eccentric 84 on the guiding organ 72 and of the latter on the second arm 22 are done, the plate 86 is arranged facing the recess 50 of the base 14.

The impact of the rotation of the eccentric 84 on the operation of the device 12 will now be described in relation to FIGS. 5 and 6, which are simplified views similar to the view of FIG. 1.

Figure 5:
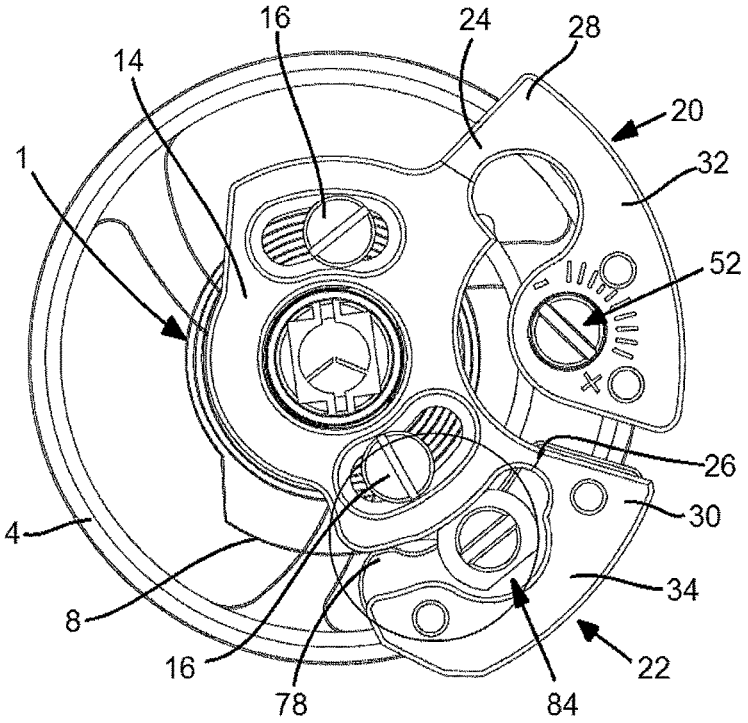
Figure 6:
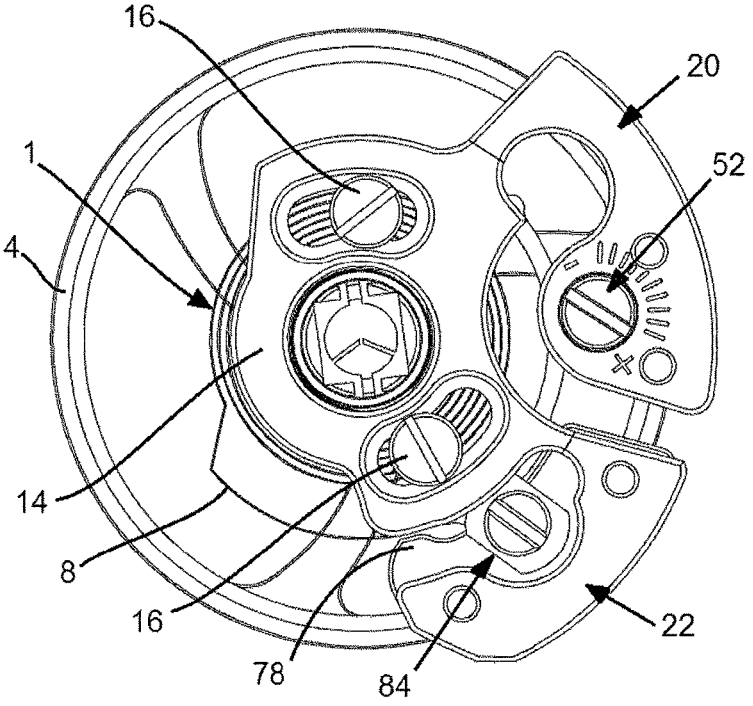

FIG. 5 shows the device 12 in a first configuration corresponding to the current operation of the sprung balance, while FIG. 6 shows it in a second, assembly or adjusting configuration.

It appears that the eccentric 84 can pivot between two functional positions: a first one in which it is not situated in contact with the base 14 (FIG. 5), and a second one in which its plate 86 bears on the bottom of the recess 50 to separate its foot 82, and therefore the second portion 34 of the second arm 22, from the base 14 (FIG. 6).

The preceding explanations show that the eccentric 84 acts as a control organ, movable to alternatively assume first and second configurations, and arranged such that it is able to act on the second arm 22, via its foot 82, to deform it elastically when it goes from its first configuration, illustrated in FIG. 5, to its second configuration, illustrated in FIG. 6. Indeed, the action of the plate 86 on the base 14 of the device, by going from a truncated portion with a small radius to a solid portion with a larger radius, causes a separation of the eccentric 84 relative to the base 14, by deformation of the second arm 22.

Thus, the first and second configurations of the eccentric 84 are respectively associated with a first position of the second arm 22, in which the sabot 78 is situated at a distance from the support surface 40 equal to a distance predefined by construction, to cooperate with the terminal coil 8, and with a second position of the second arm 22, in which the sabot 78 is situated at a distance from the support surface 40 greater than the predefined distance and no longer cooperates with the terminal coil 8.

The predefined distance can be obtained by construction by configuring and sizing the second arm 22 such that the sabot 78 is placed in the selected location when the second arm 22 is free of any stress.

In particular, it is preferably provided that the predefined distance condition is met when the sabot 78 is arranged abutting against the base 14, more specifically against the support sole 42 and the rim 44, the dimensions of which are preferably adapted, during manufacturing, to the dimensions of the balance spring 1 to be used. Thus, the second arm 22 is advantageously configured and sized such that it has a pre-stress when resting, such that the sabot 78 is arranged abutting against the base 14, to guarantee the maintenance of the balance spring in its service position, even in case of impact. The predefined distance is then defined by the width of the support sole 42 and of the rim 44, measured from the support surface 40.

The support surface 40, the support sole 42, the rim 44 and the sabot 78 therefore define a closed housing with a rectangular cross-section for the balance spring when the second arm 22 is in its first position.

In general, it is possible to provide that the sabot 78 is arranged bearing against the terminal coil 8 when it is positioned at the predefined distance from the support surface 40, or alternatively, that a small space is preserved between them, based on the desired effect and without going beyond the scope of the present invention.

When the eccentric 84 is in its second configuration, the locking organ may for example be neutralized to allow a translation of the terminal coil 8 relative to the base 14, leading to an adjustment of the active length of the balance spring 1.

In the particular case of the preferred embodiment, shown as a non-limiting illustration, the locking organ 52 is arranged in its support (the assembly plate 62) so as to be able to pivot. Thus, when the eccentric 84 is in its second configuration, it suffices to rotate the locking organ 52 counterclockwise in FIG. 6 to shorten the active length of the balance spring or clockwise to elongate it.

The locking organ 52 thereby performs a knurling-roller function, but without causing any damage to the balance spring 1, given how it is built, as previously described.

Furthermore, the preceding explanations also show that the placement of the balance spring 1 on the corresponding clockwork movement is simplified owing to the features of the device 12. Indeed, when the eccentric 84 is in its second configuration, the terminal coil 8 of the balance spring 1 can simply be deposited on the support sole 42 in order to be placed against the support surface 40, the first arm 20 being separated by elastic deformation, to free a passage for the balance spring 1 between the locking organ 52 and the support surface 40.

Once the terminal coil 8 is in place toward its service position, the first arm 20 can be freed to allow the locking organ 52 to perform its function, by pressing the balance spring 1 against the support surface 40.

The watch can be put into beat by rotating the base 14 in reference to the balance-cock 6.

The active length of the balance spring 1 can then be adjusted by rotating the locking organ 52 in one direction or the other, before freeing the second arm 22 by rotating the eccentric 84 so as to position one of its truncated portions facing the base 14. The sabot 78 is then positioned at the predefined distance from the support surface 40 and the sprung balance is ready to operate.

Owing to the construction of the device for assembling and adjusting a balance spring described above, one obtains such a device that is easy to assemble, is reliable, and offers very easy-to-implement possibilities for adjusting the sprung balance. In particular, it will be noted that the placement or adjustment of the balance spring can be done without causing any damage that may harm its chronometric qualities. Furthermore, when the second arm is separated to free the balance spring, then put back into place, in the device according to the present invention, the distance separating the sabot from the support surface is precisely respected, by construction.

The preceding description endeavors to describe one particular embodiment as a non-limiting illustration, and the invention is not limited to certain specific features described above, such as the shapes illustrated and described for the base and the arms of the assembly and adjusting device, as well as for the control (here, the eccentric 84) and locking organs. Many variant embodiments may be considered without going beyond the scope of the invention. In particular, the structure and operating mode of the locking organ can be modified by one skilled in the art, based on his own needs, without going beyond the scope of the invention.

According to one variant, it would for example be possible to provide a control organ on the first arm similar to that of the second arm, and cooperating with the base, to still further facilitate the placement of the balance spring in the device.

The invention claimed is:

1. A device for assembling and adjusting a balance spring intended to cooperate with a terminal coil of a balance spring whereof the inner end is secured to a balance-staff of a balance, said balance-staff being pivoted in a balance-cock, the device including a base intended to be assembled to the balance-cock with an adjustable angular orientation, and comprising a substantially cylindrical support surface with a radius substantially equal to the radius of the terminal coil, and a support sole adjacent to the support surface, said support surface and said support sole defining a service position of the terminal coil, a first arm extending from said base and supporting a locking organ for locking the terminal coil arranged to keep the terminal coil bearing against the support surface, said device further including a second arm extending from said base and supporting a sabot able to be arranged at a predefined distance from said support surface to cooperate with the terminal coil, and a control organ movable between first and second configurations and arranged such that it is able to act on the second arm and deform it elastically to move the sabot in reference to said base, said first and second configurations of said control organ being associated, respectively, with a first position of said second arm, in which said sabot is situated at a distance from said support surface equal to said predefined distance, and with a second position of said second arm, in which said sabot is situated at a distance from said support surface greater than the predefined distance.

2. The device according to claim 1, wherein said first and second configurations of said control organ are stable configurations.

3. The device according to claim 2, wherein said second arm includes, from said base toward its free end, a first substantially radial portion ending with a bend providing a connection with a second substantially tangential portion, said first and second portions and said bend being arranged such that the elastic deformation experienced by said second arm, in response to a change in configuration of said control organ, occurs essentially at said first portion.

4. The device according to claim 2, wherein said locking organ includes a knurling-roller arranged on said first arm such that it is able to pivot in response to an appropriate action by a user to translate the terminal coil in one direction or the other based on its rotation direction.

5. The device according to claim 1, wherein said control organ comprises an eccentric arranged on said second arm such that it can be pivoted in response to an action by a user, to go from one of its configurations to the other and exert pressure on said base, in its second configuration, such that said sabot is situated at a distance from said support surface greater than the predefined distance.

6. The device according to claim 5, wherein said second arm includes, from said base toward its free end, a first substantially radial portion ending with a bend providing a connection with a second substantially tangential portion, said first and second portions and said bend being arranged such that the elastic deformation experienced by said second arm, in response to a change in configuration of said control organ, occurs essentially at said first portion.

7. The device according to claim 6, wherein said sabot is arranged abutting against said base in said first position of said second arm.

8. The device according to claim 7, wherein said locking organ includes a knurling-roller arranged on said first arm such that it is able to pivot in response to an appropriate action by a user to translate the terminal coil in one direction or the other based on its rotation direction.

9. The device according to claim 6, wherein said locking organ includes a knurling-roller arranged on said first arm such that it is able to pivot in response to an appropriate action by a user to translate the terminal coil in one direction or the other based on its rotation direction.

10. The device according to claim 5, wherein said locking organ includes a knurling-roller arranged on said first arm such that it is able to pivot in response to an appropriate action by a user to translate the terminal coil in one direction or the other based on its rotation direction.

11. The device according to claim 1, wherein said control organ comprises an eccentric arranged on said base such that said control organ can be pivoted in response to an action by a user, to go from one of its first and second configurations to the other and exert pressure on said second arm, in its second configuration, such that said sabot is situated at a distance from said support surface greater than said predefined distance.

12. The device according to claim 1, wherein said second arm includes, from said base toward its free end, a first substantially radial portion ending with a bend providing a connection with a second substantially tangential portion, said first and second portions and said bend being arranged such that the elastic deformation experienced by the second arm, in response to a change in configuration of said control organ occurs essentially at said first portion.

13. The device according to claim 12, wherein said sabot is arranged abutting against said base in said first position of said second arm.

14. The device according to claim 12, wherein said locking organ includes a knurling-roller arranged on said first arm such that it is able to pivot in response to an appropriate action by a user to translate the terminal coil in one direction or the other based on its rotation direction.

15. The device according to claim 1, wherein said sabot is arranged abutting against said base in said first position of said second arm.

16. The device according to claim 1, wherein said first arm includes, from said base toward its free end, a first substantially radial portion ending with a bend providing the connection with a second substantially tangential portion, the first and second portions and said bend being arranged such that said first arm is able to undergo an elastic deformation occurring essentially at its first portion.

17. The device according to claim 1, wherein said locking organ includes a knurling-roller arranged on said first arm such that it is able to pivot in response to an appropriate action by a user to translate the terminal coil in one direction or the other based on its rotation direction.

18. The device according to claim 17, wherein said knurling-roller includes a substantially cylindrical portion made from a synthetic material intended to be arranged bearing against the terminal coil in its service position.

19. A clockwork movement provided with a device for assembling and adjusting a balance spring according to claim 1.

20. A timepiece including a clockwork movement according to claim 19.

* * * * *